US006453876B1

(12) United States Patent
Fukutomi et al.

(10) Patent No.: US 6,453,876 B1
(45) Date of Patent: Sep. 24, 2002

(54) FUEL INJECTION SYSTEM

(75) Inventors: Norihisa Fukutomi, Tokyo (JP); Osamu Matsumoto, Tokyo (JP); Masayuki Aota, Tokyo (JP)

(73) Assignee: Misubishi Denki Kabushiki Kaisha, Tokyo (JP)

( * ) Notice: Subject to any disclaimer, the term of this patent is extended or adjusted under 35 U.S.C. 154(b) by 47 days.

(21) Appl. No.: 09/685,136

(22) Filed: Oct. 11, 2000

(30) Foreign Application Priority Data

Nov. 24, 1999 (JP) ..... 11-332944

(51) Int. Cl.[7] ..... F02M 51/00
(52) U.S. Cl. ..... 123/490; 361/152
(58) Field of Search ..... 123/490; 361/152, 361/154

(56) References Cited

U.S. PATENT DOCUMENTS 6,102,009 A * 8/2000 Nishiyama ..... 123/456
6,234,150 B1 * 5/2001 Watanabe ..... 123/490
6,332,455 B1 * 12/2001 Sumida et al. ..... 123/490

FOREIGN PATENT DOCUMENTS

JP 3-7834 2/1991
JP 4-23100 4/1992
JP 10-47140 2/1998

* cited by examiner

*Primary Examiner*—John Kwon
(74) *Attorney, Agent, or Firm*—Sughrue Mion, PLLC

(57) ABSTRACT

The fuel injection system includes an injector 7 to be electromagnetically driven, a control device 2 for outputting a drive signal having first current-carrying time T1 and second current-carrying time T2 to this injector 7, and a drive device 6 for passing a large current to open a valve of the injector 7 during the first current-carrying time T1 and passing a small current to hold the injector 7 in a valve opening state during the second current-carrying time T2. The system is constructed so that the first current-carrying time T1 is set to the time shorter than valve opening required time T0 from a current-carrying start of the injector 7 to full opening and this time difference is set to the value shorter than valve closing operation delay time from a current break of the injector 7 in the case of breaking a current in the first current-carrying time T1 to a start of a valve closing operation.

2 Claims, 3 Drawing Sheets

FUEL INJECTION SYSTEM

BACKGROUND OF THE INVENTION

This invention relates to control of a fuel injection quantity of an internal combustion engine mounted in a vehicle, and particularly to a fuel injection system for controlling a fuel injection quantity of a direct injection type internal combustion engine for directly injecting fuel into a cylinder.

With reference to control of a fuel injection quantity of an internal combustion engine, various techniques are conventionally disclosed, and a control method suitable for a so-called MPI injector for injecting fuel into an intake passage of the internal combustion engine at multi points is disclosed in, for example, the Examined Japanese Patent Application Publication No. Hei 4-23100. When a valve of an electromagnetic drive injector is conventionally opened to inject the fuel into the internal combustion engine, it is known that a valve opening current of a large current value is passed through a solenoid of the injector in the case of opening the valve to speed operation of opening the valve and the current is switched to a valve opening hold current of a small current value necessary to maintain a valve opening state after the completion of opening the valve and this valve opening hold current is passed through the solenoid for a predetermined period of time to control a fuel injection quantity, but the fact that a relationship between current-carrying time T1 of the valve opening current and valve opening required time T0 from a current-carrying start to full opening of the valve is set to T1>T0+0.1 ms and a switch to a holding current is made after a lapse of this current-carrying time T1 of the valve opening current is disclosed in the conventional example described above.

In a mechanism of a needle valve used for such an electromagnetic drive injector, a stopper for limiting the amount of movement of a plunger for fixing a valve element is provided in order to regulate an opening of the valve, and a bounce due to a collision of the plunger with this stopper occurs and this bounce interferes with linearity of characteristics of the fuel injection quantity to injection time to adversely affect accuracy of the control of the fuel injection quantity, so that in the conventional example described above, the current-carrying time of the valve opening current is made longer than the valve opening required time to apply a strong electromagnetic attraction force to the plunger and the bounce is controlled while its extended time is regulated to 0.1 ms in order to ensure the minimum value of the fuel injection quantity per one action.

Also, another example of conventional art for controlling this bounce phenomenon to improve controllability of the fuel injection quantity is disclosed in the Examined Japanese Patent Application Publication No. Hei 3-7834. The technique disclosed in this publication is constructed so that the current-carrying time T1 of the valve opening current is set shorter than the valve opening required time T0 and the current is once broken or the current is switched to a low level of a current value to reduce a valve opening speed and immediately before the plunger collides with the stopper, namely reaches the valve opening required time T0, a current with a value larger than a hold current is passed to control the bounce and the current is switched to the hold current after an opening of a valve has stabilized, and by performing the control in this manner, a speed of a collision between the plunger and the stopper is reduced and further an attraction force in the case of occurrence of the bounce is strengthened to control the bounce.

Since a cylinder injection injector for directly injecting fuel into a cylinder of an internal combustion engine, (a so-called DI injector) is premised on a stratified-charge combustion within the cylinder, the mass mixture ratio of air to fuel is normally set larger than 14.7 of the theoretical mixture ratio and for this reason, the minimum injection quantity of fuel needs to be set small compared with that of the MPI injector. Also, even when it is not premised on the stratified-charge combustion, a predetermined quantity of fuel needs to be injected in a shorter time for the cylinder injection and a flow gain of the injector is largely set, so that the injection quantity per time becomes large and there is a problem that injection time in the case of injecting the minimum injection quantity of fuel needs to be more reduced. In order to obtain the minimum injection quantity of this injector as an stable value, it is found from experimental results that an injection pulse width needs to be set to the substantially same time as the valve opening required time T0 or longer than or equal to the time T0, and the bounce phenomenon needs to be controlled in a manner similar to the conventional example.

Also, in construction of the valve used for the injector, valve closing required time until closing the valve after the passage of current through the solenoid is broken exists, and this valve closing required time is affected by a damping factor of a magnetic flux applied to the plunger as the electromagnetic attraction force other than mechanical inertia of a valve mechanism. The damping factor of this magnetic flux damps according to a time constant determined by various specifications of the plunger and is commonly called a residual flux or a response delay of the magnetic flux, and the delay time from a current break to a start of valve closing operation depends on a strength of a magnetomotive force in the case of the current break, and the residual flux becomes larger with an increase in the magnetomotive force and it takes time to extinction of the magnetic flux, so that this delay time of the valve closing operation becomes long and accordingly, the valve closing required time becomes long and the minimum injection quantity also increases.

In the technique disclosed in the Examined Japanese Patent Application Publication No. Hei 4-23100 of the conventional example described above, the current-carrying time T1 of the valve opening current is made longer than the valve opening required time T0 by 0.1 ms to control the bounce and along with the delay time of the valve closing operation, an extension of this valve opening time of 0.1 ms has a great influence on the control of the minimum injection quantity and it is difficult to control the injection quantity to a predetermined value or less. Also, in the technique disclosed in the Examined Japanese Patent Application Publication No. Hei 3-7834, since the valve opening speed is reduced, the valve opening required time T0 becomes long and further, it is constructed so as to pass a current with a large value immediately before arrival at T0 and hold this until the opening of the valve stabilizes, so that the valve opening time becomes long and it is impossible to reduce the minimum injection quantity, and any of the techniques do not suit the direct injection type internal combustion engine.

SUMMARY OF THE INVENTION

An object of the invention is to obtain a fuel injection system which allows a decrease in the minimum injection quantity and control of a bounce in a simple control configuration and has the control contents suitable for a cylinder injection injector for directly injecting fuel into a cylinder of an internal combustion engine.

A fuel injection system according to the invention comprises an injector to be electromagnetically driven, injection control means for outputting a drive signal having first current-carrying time and second current-carrying time to this injector, and injector drive means for passing a large current to open a valve of the injector during the first current-carrying time and passing a small current to hold the injector in a valve opening state during the second current-carrying time, and is constructed so that the first current-carrying time is set to the time shorter than valve opening required time from a current-carrying start to full opening of the injector and this time difference is set to the value shorter than valve closing operation delay time from a current break in the case of breaking a current in the first current-carrying time to a start of valve closing operation by the injector.

Also, the fuel injection system is constructed so that current-carrying stop time for making a current-carrying stop is set between the first current-carrying time and the second current-carrying time and this current-carrying stop time is set to the value substantially equal to the time difference between first valve closing required time to the valve closing after the current break of the first current-carrying time and second valve closing required time to the valve closing after the current break of the second current-carrying time.

DETAILED DESCRIPTION OF THE PREFERRED EMBODIMENTS (First Embodiment)

Figure 1:
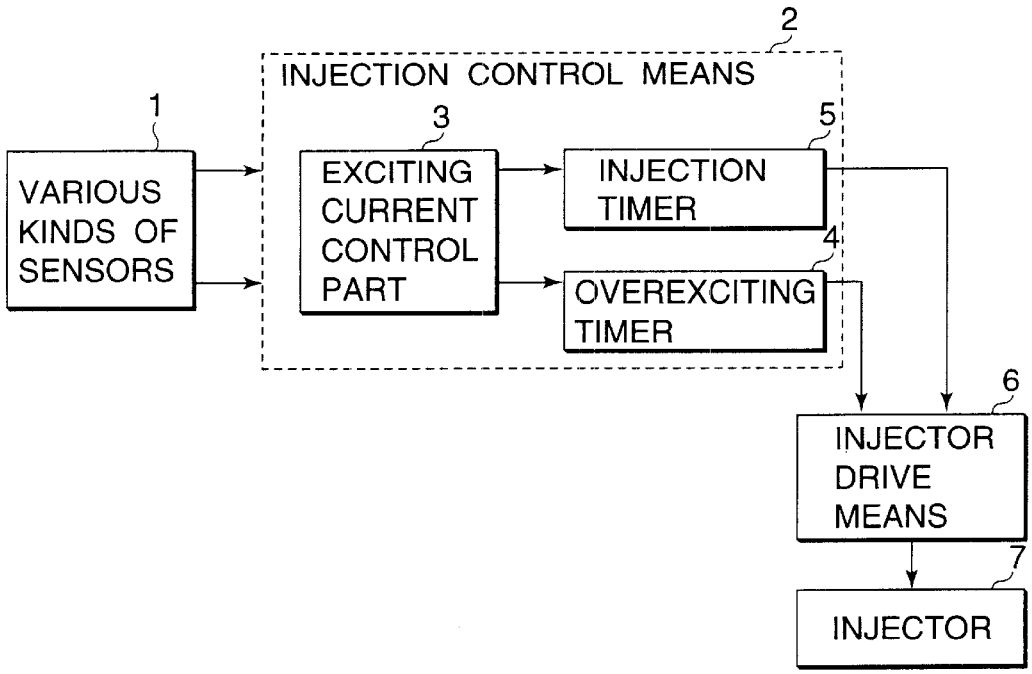
FIG. 1 is a block diagram showing a configuration of a fuel injection system of a first embodiment of this invention.
Figure 2:
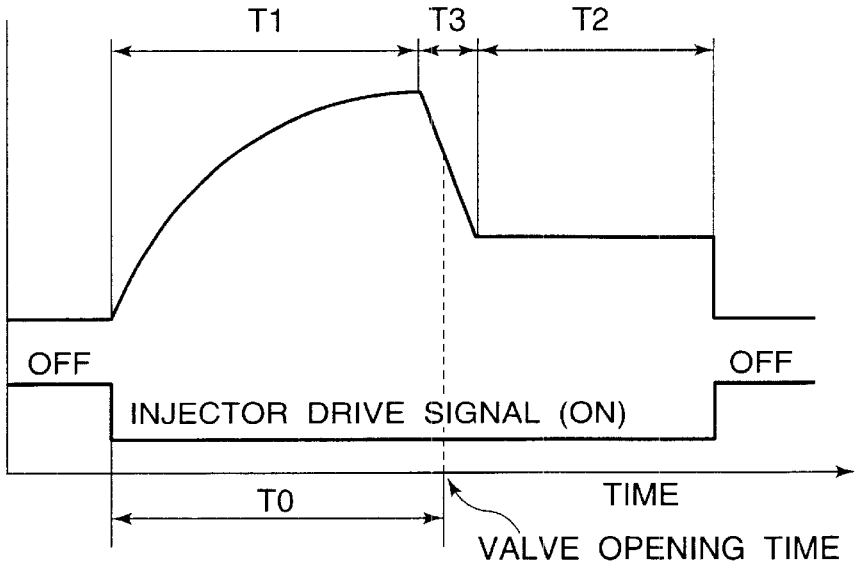
FIG. 2 is an explanatory diagram showing operations of the fuel injection system of the first embodiment of the invention.
Figure 3:
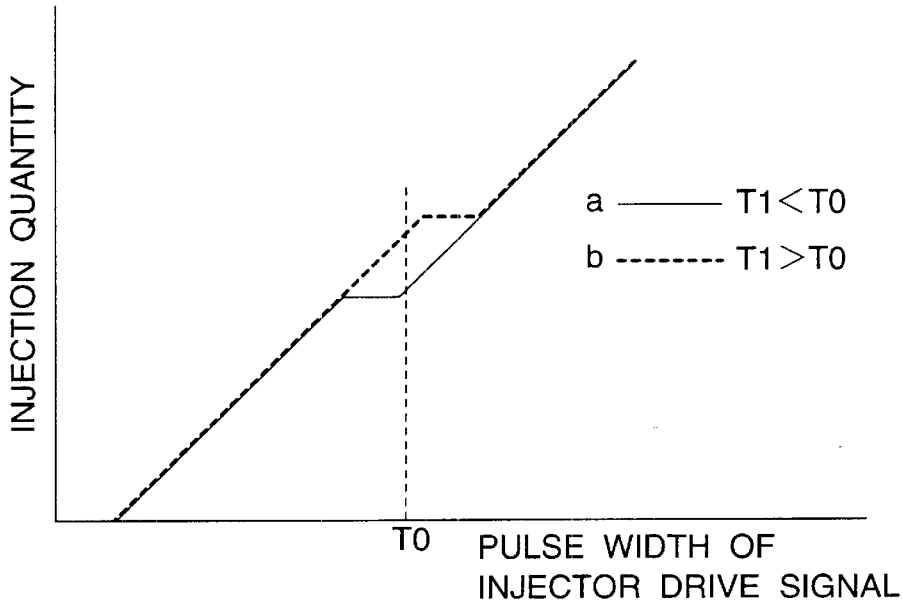
FIG. 3 is an explanatory diagram showing operating characteristics of the fuel injection system of the first embodiment of the invention.
Figure 4:
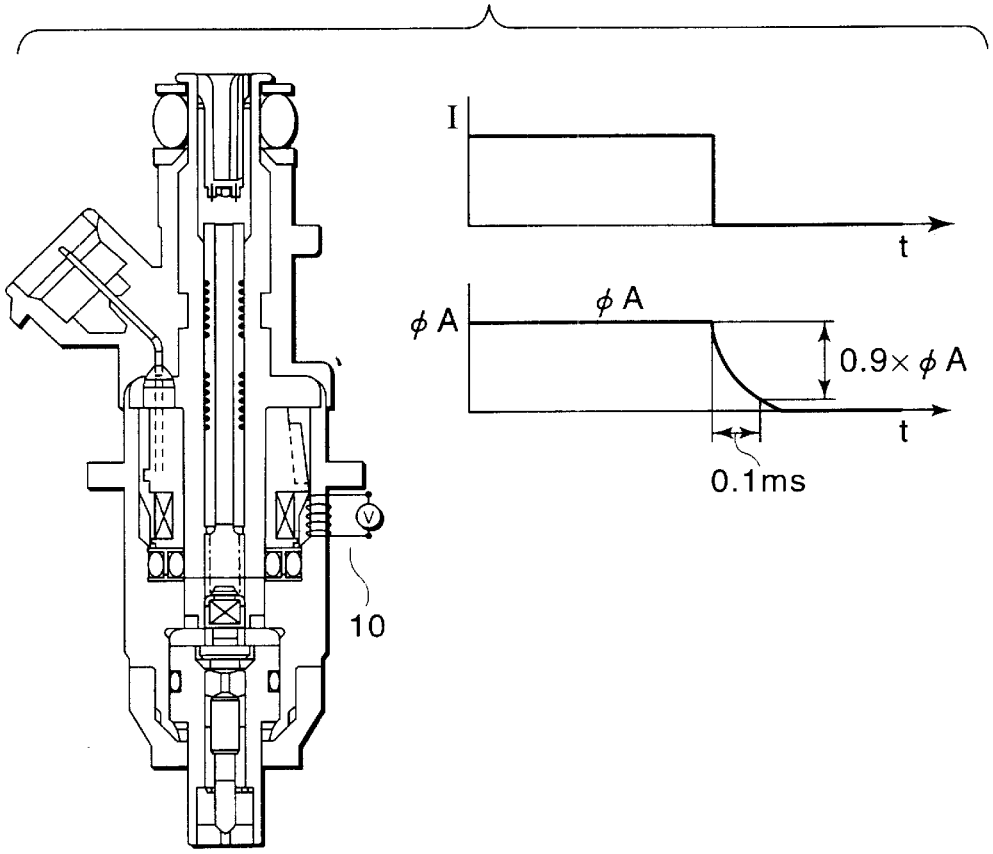
FIG. 4 is an explanatory diagram showing the operations of the fuel injection system of the first embodiment of the invention.

FIG. 1 is a block diagram showing a configuration of a fuel injection system of a first embodiment of the invention, and FIGS. 2 to 4 are explanatory diagrams showing operations of the fuel injection system of the first embodiment of the invention, and reference characters used in the following description correspond to reference characters used in the description of the conventional examples. In FIG. 1, numeral 1 are various kinds of sensors for detecting operating parameters of an internal combustion engine such as a rotational angle, an intake air volume and a cooling water temperature of the internal combustion engine, and numeral 2 is injection control means for making calculations such as a required quantity of fuel or injection timing by input from the various kinds of sensors 1, and the injection control means 2 includes an exciting current control part 3 for setting current-carrying conditions, an overexciting timer 4 for setting current-carrying time of an overexciting current for valve opening operation and an injection timer 5 for setting current-carrying time of a hold current. Numeral 6 is injector drive means for controlling a current from power supply (not shown) by output of these timers 4 and 5 to drive an electromagnetic drive injector 7 for cylinder injection.

The injection control means 2 calculates the injection timing and outputs an injector drive signal indicated in FIG. 2. This injector drive signal consists of first current-carrying time T1 for actuating the overexciting timer 4, current-carrying stop time T3 for stopping the passage of current and second current-carrying time T2 for actuating the injection timer 5 to pass a hold current, and the injector drive means 6 passes the overexciting current for valve opening operation during the first current-carrying time T1 and the hold current for valve opening hold during the second current-carrying time T2 through a solenoid (not shown) of the injector 7. In the injector 7 for cylinder injection, a valve opening pressure is set to 5 Mpa or higher in order to withstand a combustion pressure occurring within a cylinder of the internal combustion engine and in the case of valve opening operation, a large current for making a magnetic path in an overexciting state to increase a valve opening force is passed through the solenoid of the injector 7. Also, since the hold current is set to a small current necessary to hold a valve opening state, the injector drive means 6 is constructed so as to reduce a power supply voltage by chopper control and control a current value passed through the solenoid.

A state of a change in magnetic flux of the magnetic path of the injector 7 when the passage of current through the solenoid of the injector 7 is broken is shown in FIG. 4. In relation to a break in an exciting current I, the magnetic flux of the magnetic path damps by a constant damping factor according to a time constant determined by various specifications of the injector 7 as shown in Φ of the drawing. A detailed description of a configuration of the injector shown in the drawing is omitted, and as a result of making measurement by providing a search coil 10 (as shown in the drawing) in the magnetic path of the injector having standard various specifications, when the passage of the overexciting current in the first current-carrying time T1 was broken, it took a time of 0.1 ms to reduce a magnetic flux amount to 90% of an initial magnetic flux amount. This response delay of the magnetic flux indicates that an electromagnetic attraction force remains even after the break in the exciting current I and valve closing operation is not started until the magnetic flux is reduced to a value incapable of holding a valve opening state, and delay time of this valve closing operation varies according to the magnetic flux amount in the case of breaking the current, namely a value of the exciting current and for example, in the case of breaking the hold current, the valve closing operation will be started in a short time compared with the case of breaking the overexciting current.

The fuel injection system of the first embodiment of the invention is constructed so as to pay attention to time of this response delay of the magnetic flux and control the passage of current, and is constructed so as to set the first current-carrying time T1 which is current-carrying time T1 when opening the valve shorter than valve opening required time T0 of the injector 7 by a predetermined time as shown in FIG. 2. The system is constructed so that when time in which the magnetic flux damps to a value starting the valve closing operation due to the response delay of the magnetic flux to the break in the overexciting current passed during the first current-carrying time T1, namely delay time of the valve closing operation is TΦ1, setting is made as the following expression and T1 at least becomes shorter than T0.

$$T\Phi 1 > T0 - T1 \quad (1)$$

In the first current-carrying time T1, the overexciting current with a large current value is passed in order to cope with the valve opening pressure of 5 Mpa and increase the valve opening speed corresponding to the cylinder injection as described above, so that even when the first current-carrying time T1 is set as described above, a strong attraction force due to the response delay of the magnetic flux acts on a plunger (not shown) of the injector 7 immediately after the break in the passage of current and thus, the valve is full opened in T0 without a decrease in the valve opening time and a bounce phenomenon in the case of becoming in a full opening state is also controlled. Also, since the attraction force acting on the plunger is in the middle of damping in the time T0, when the injector drive signal is turned off immediately after this, the magnetic flux vanishes speedily to start the valve closing operation and valve closing time becomes speedy, with the result that the minimum injection quantity of fuel can be made to a small value.

FIG. 3 is a diagram showing injection characteristics of the fuel injection system set in this manner. FIG. 3 shows a relationship of an injection quantity to a time width of the injector drive signal. A characteristic a indicated by a solid line is in the case that a relationship between the first current-carrying time T1 and the valve opening required time T0 is T1<T0 based on the first embodiment of the invention, and a characteristic b indicated by a dotted line is in the case that a current-carrying condition is T1>T0. The injection quantity increases with the current-carrying time, but a state of injection varies when the first current-carrying time is completed to shift to the hold current as is publicly known, and thereafter is again stabilized to increase. Here, in comparison between both cases in an injector having typical specifications, when the injector in which the valve opening required time T0 is 1 ms and the response delay of the magnetic flux as shown in FIG. 4 is 0.1 ms is used and the current-carrying time is set to T1=T0−TΦ1 which is the limit value of expression (1) described above as the characteristic a, the minimum injection quantity could be reduced by approximately 10% as compared with the characteristic b, namely the case of making the current-carrying time slightly longer than the valve opening required time.

(Second Embodiment)

A fuel injection system of a second embodiment of the invention is constructed so as to set current-carrying stop time T3 between the first current-carrying time T1 and the second current-carrying time T2 and regulate this current-carrying stop time T3 to a predetermined value in an explanatory diagram of operations of FIG. 2 in addition to the setting of the first embodiment. When first valve closing required time by a delay of a magnetic flux in the case of breaking the overexciting current supplied to the injector 7 in the first current-carrying time T1 is TC1 and second valve closing required time in the case of breaking the hold current supplied in the second current-carrying time T2 is TC2, a value of the current-carrying stop time T3 is set as the following expression.

$$T3 \approx TC1 - TC2 \quad (2)$$

Figure 5:
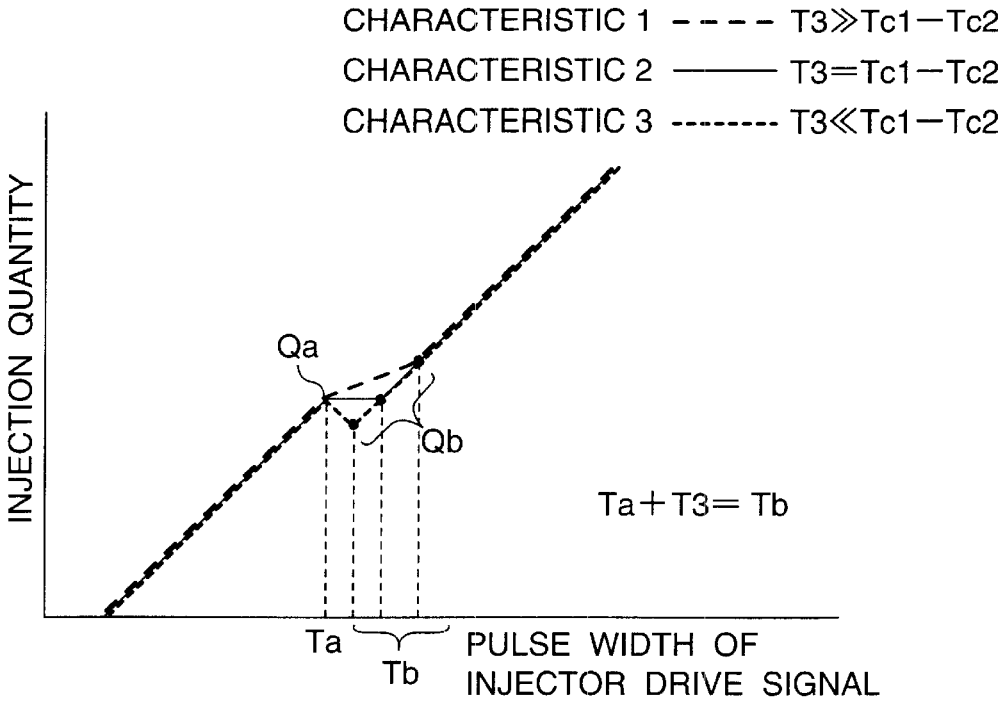
FIG. 5 is an explanatory diagram showing operating characteristics of a fuel injection system of a second embodiment of the invention.

FIG. 5 is experimental data showing a relationship of an injection quantity to a time width of an injector drive signal by changing this stop time T3. In injectors such as a cylinder injection injector in which the first current-carrying time is made in an overexciting state to increase the valve opening speed, when the current-carrying stop time T3 after the completion of the first current-carrying time is made to T3<TC1−TC2 and the hold current is immediately passed, the result is that an unstable phenomenon in a change in the injection quantity in the case of current-carrying switching occurs. The contents is indicated in a characteristic 3 of FIG. 5, and when the first current-carrying is completed at time Ta and the second current-carrying which is the hold current is started at time Tb, a fuel injection quantity Qa at the Ta is decreased to a fuel injection quantity Qb at the Tb and thus, accuracy of flow control becomes worse.

On the contrary, when the stop time T3 after the first current-carrying is set to T3>TC1−TC2, a stable characteristic is indicated as a characteristic 1, but the injection quantity ranging from the time Ta to the time Tb tends to increase, so that the minimum injection quantity cannot be controlled low. In order to control the minimum injection quantity while keeping the injection quantity characteristics to the time width of the injector drive signal in a substantially stable state, the best result is to substantially conform the time T3 to the expression (2) and as a result of this, stable flow control and a large flow dynamic range can be obtained.

Figure 6:
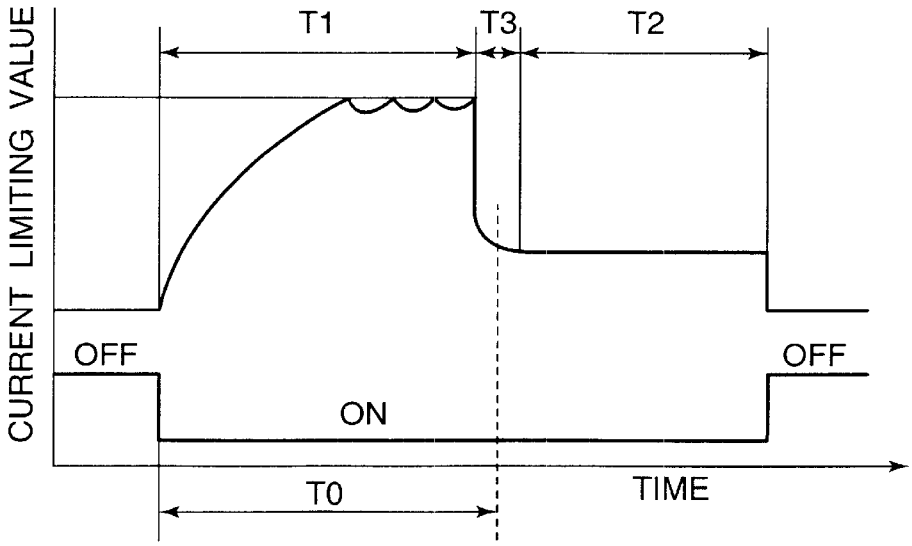
FIG. 6 is an explanatory diagram showing a modified example of a current passed through a fuel injection system of the invention.

Incidentally, the descriptions about chopper control to perform current-limiting of the second current-carrying time have been given above. In cases that an impedance of the solenoid of the injector 7 is extremely low or that a rise in current in the first current-carrying time is rapid and the saturation current is too high, the chopper control needs to be performed in order to limit the maximum current in the first current-carrying time as shown in FIG. 6, but even in such cases, effects by identification of the first current-carrying time T1 and the stop time T3 described in the first and second embodiments can be obtained.

As described above, according to a fuel injection system of the invention, first current-carrying time for performing valve opening operation is set to the time shorter than valve opening required time of an injector and also the time difference is set to the time shorter than delay time of a magnetic flux by a current value at the completion of the first current-carrying time, and also current-carrying stop time is provided between the first current-carrying time and second current-carrying time for passing a hold current and this current-carrying stop time is set to the time substantially equal to the time difference between valve closing required time when breaking an overexciting current supplied in the first current-carrying time and valve closing required time when breaking a hold current supplied in the second current-carrying time, so that the minimum injection quantity of fuel can be set to a small value, and stable flow control and a large flow dynamic range can be obtained and thus, the fuel injection system suitable for a cylinder injection injector can be obtained.

What is claimed is:

1. A fuel injection system comprising:

an injector to be electromagnetically driven, injection control means for outputting a drive signal having first current-carrying time and second current-carrying time to said injector, and injector drive means for passing a large current to open a valve of said injector during the first current-carrying time and passing a small current to hold said injector in a valve opening state during the second current-carrying time, wherein the first current-carrying time is set to the time shorter than valve opening required time from a current-carrying start to full opening of said injector, and the time difference is set to the value shorter than valve closing operation delay time from a current break in a case of breaking a current in the first current-carrying time to a start of valve closing operation by said injector.

2. The fuel injection system as defined in claim 1, wherein current-carrying stop time for making a current-carrying stop is set between the first current-carrying time and the second current-carrying time, and the current-carrying stop time is set to the value substantially equal to the time difference between first valve closing required time to the valve closing after the current break of the first current-carrying time and second valve closing required time to the valve closing after the current break of the second current-carrying time.

* * * * *